United States Patent [19]

Vornberger

[11] 3,932,907

[45] Jan. 20, 1976

[54] ROUGHING MACHINE

[75] Inventor: Walter Vornberger, Tewksbury, Mass.

[73] Assignee: International Shoe Machine Corporation, Nashua, N.H.

[22] Filed: Feb. 3, 1975

[21] Appl. No.: 546,223

[52] U.S. Cl. ..... 12/1 R; 12/77

[51] Int. Cl.[2] ..... A43D 95/00

[58] Field of Search ..... 12/1 R, 1 A, 1 B, 77, 70, 12/78, 79.3, 79.5, 86, 87, 17 R

[56] References Cited

UNITED STATES PATENTS

| | | | |
|---|---|---|---|
| 2,249,742 | 7/1941 | Brostrom | 12/77 |
| 3,733,632 | 5/1973 | Bechtold | 12/1 R |
| 3,780,390 | 12/1973 | Braum | 12/1 R |
| 3,843,985 | 10/1974 | Leonhardt | 12/1 R |

*Primary Examiner*—Patrick D. Lawson
*Attorney, Agent, or Firm*—Albert Gordon

[57] ABSTRACT

A roughing machine for operating on a shoe assembly, comprised of a last having an insole located on its bottom and an upper mounted thereon with the upper margin lying against and being secured to the periphery of the insole, by roughing the upper margin. The machine includes a roughing tool that is mounted to a tool mount. The tool mount includes a pair of tines that are yieldably urged against the bottom of the shoe assembly that is supported bottom-up in the machine and a sensing member that is movable from an idle position to a position of engagement with the side of the shoe assembly. A triggering arrangement causes the sensing member to move into engagement with the side of the shoe assembly in response to the engagement of the tines with the bottom of the shoe assembly.

2 Claims, 12 Drawing Figures

ROUGHING MACHINE

BACKGROUND OF THE INVENTION

U.S. Pat. No. 3,843,985 discloses a roughing machine for operating on a shoe assembly comprised of a last having an insole located on its bottom and an upper mounted thereon with the upper margin lying against and being secured to the periphery of the insole. U.S. Pat. Nos. 3,831,405 and 3,854,250 disclose modifications of the machine of Pat. No. 3,843,985.

In this machine, the shoe assembly is supported bottom-up on a shoe assembly support. The machine includes a slide mounted for forward-rearward movement toward and away from the shoe assembly and a first motor connected to the slide to effect this movement. A tool mount is mounted to the slide for heightwise movement and second yieldable motors are connected to the tool mount for effecting this heightwise movement. Mounted to the tool mount are a pair of tines and a sensing member located below the tines. Actuable operating means so connect the sensing member and the first motor as to cause the first motor to move the slide from a rearward idle position wherein the sensing member is spaced from the shoe assembly forwardly until the sensing member engages a particular portion of the side of the shoe assembly and to enable the first motor to retain the sensing member in engagement with successive portions of the side of the shoe assembly with a consequent forward or rearward movement of the tool mount as the successive portions of the side of the shoe assembly move past the sensing member.

Initially the operating means are deactuated so that the first motor retains the slide in its idle position and the second motors are caused to retain the tool mount in an upper position spaced above the shoe assembly. This is followed by a concomitant operation of the second motors to yieldably lower the tool mount so as to bring the tines into engagement with the bottom of the shoe assembly and an actuation of the operating means. After this, the shoe assembly support is so moved as to move successive portions of the shoe assembly past the tool mount thereby moving successive portions of the side of the shoe assembly past the sensing member and thereby moving successive portions of the bottom of the shoe assembly past the tines. During this movement, a roughing tool that is mounted to the tool mount as to be in engagement with successive portions of the upper margin as said successive portions of the shoe assembly move past the tool mount roughs the upper margin.

SUMMARY OF THE INVENTION

The concomitant lowering of the tines and forward movement of the sensing member, as described above, sometimes has the undesirable effect of causing the tines to descend outwardly of the shoe assembly and thus not come into engagement with the upper margin and on other occasions has the undesirable effect of causing the sensing member to cross over the uppermost portion of the side of the shoe assembly without engaging the side of the shoe assembly. In order to overcome this deficiency, in accordance with this invention, the prior machine has been modified by first causing the second motors to yieldably lower the tool mount so as to bring the tines into engagement with the bottom of the shoe assembly and to provide triggering means that are responsive to the engagement of the tines with the bottom of the shoe assembly to actuate the operating means.

DESCRIPTION OF THE PREFERRED EMBODIMENT

Figure 1:
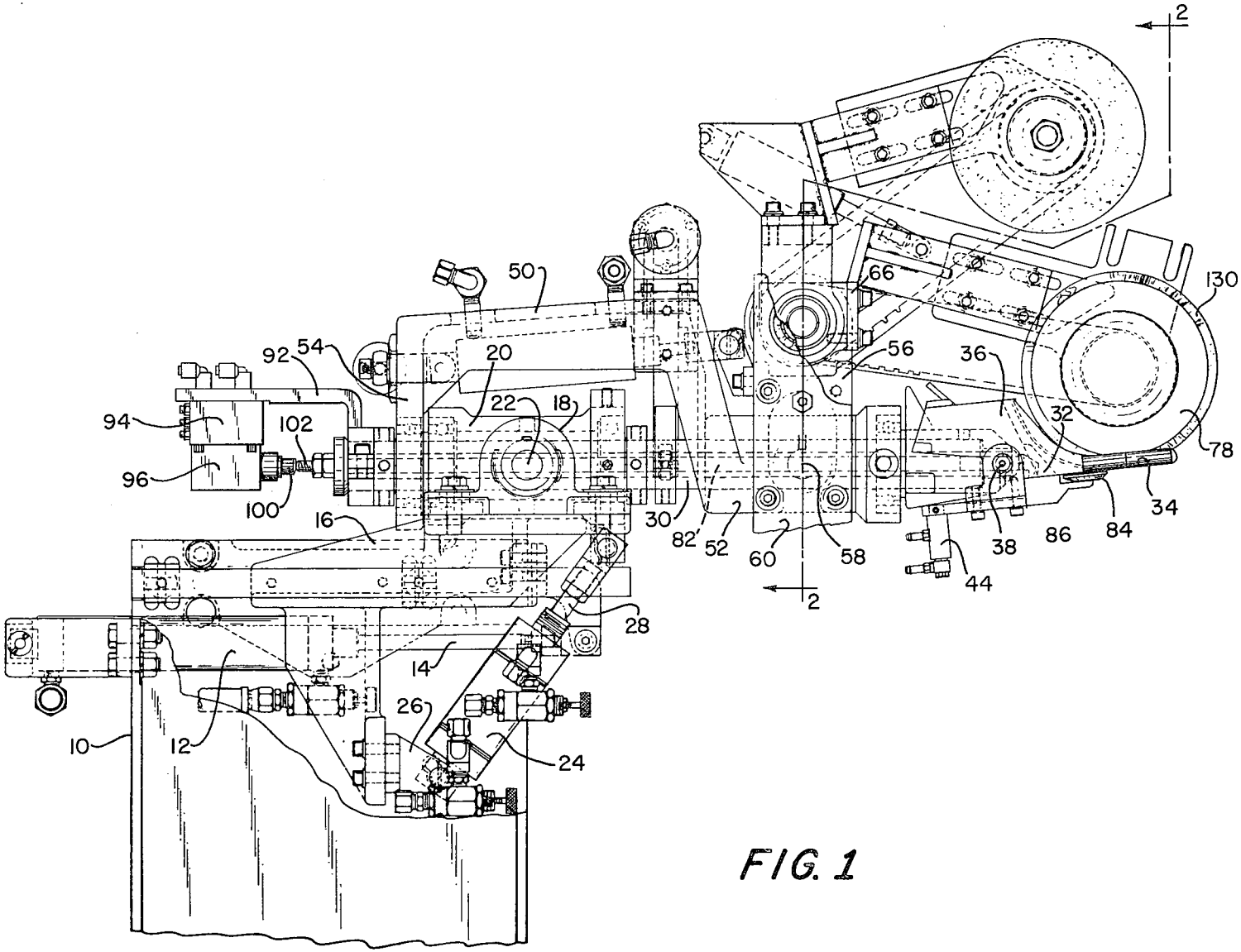
FIG. 1 is a side elevation of the machine.

Directions extending from left to right in FIG. 1 will be designated as "forward" and directions extending right to left in FIG. 1 will be designated as "rearward". The right end of the machine as seen in FIG. 1 will be considered to be its front and the left end of the machine as seen in FIG. 1 will be considered to be its back.

Referring to FIG. 1, the machine includes a frame 10 in which an hydraulically operated motor 12 is mounted. The piston rod 14 of the motor 12 is connected to a slide 16 that is mounted for forward-rearward movement in the frame 10. Trunnions 18 on the slide 16 pivotally mount a yoke 20 for heightwise swinging movement about the horizontal axis of spindles 22 that are rigid with the yoke 20 and that are rotatably mounted in the trunnions 18. A pair of air operated motors 24 (only one of which is shown in FIG. 1) are pivotally mounted on a bracket 26 on the slide 16 and have upwardly extending piston rods 28 that are pivotally mounted to the yoke 20 to effect heightwise swinging movement of the yoke 20 about the axis of the spindles 22.

Figure 2:
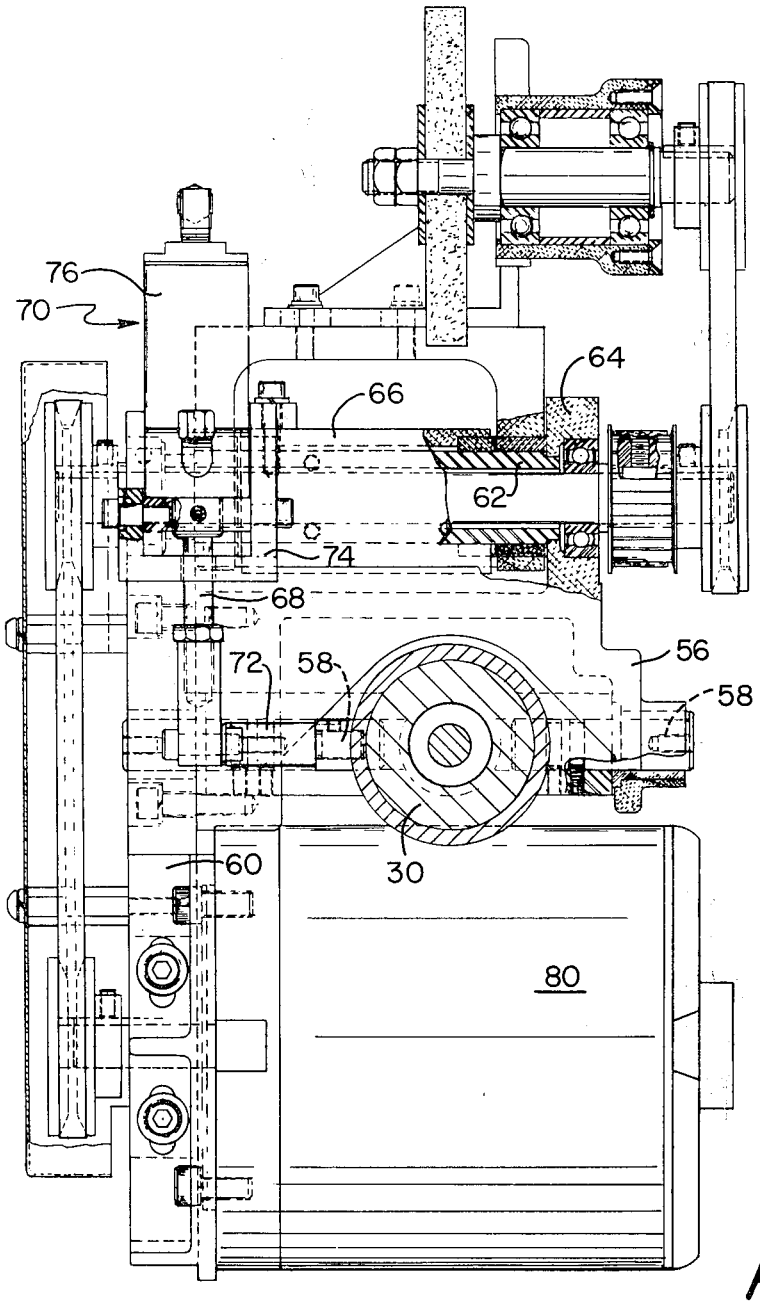
FIG. 2 is a view taken along the 2–2 of FIG. 1.
Figure 3:
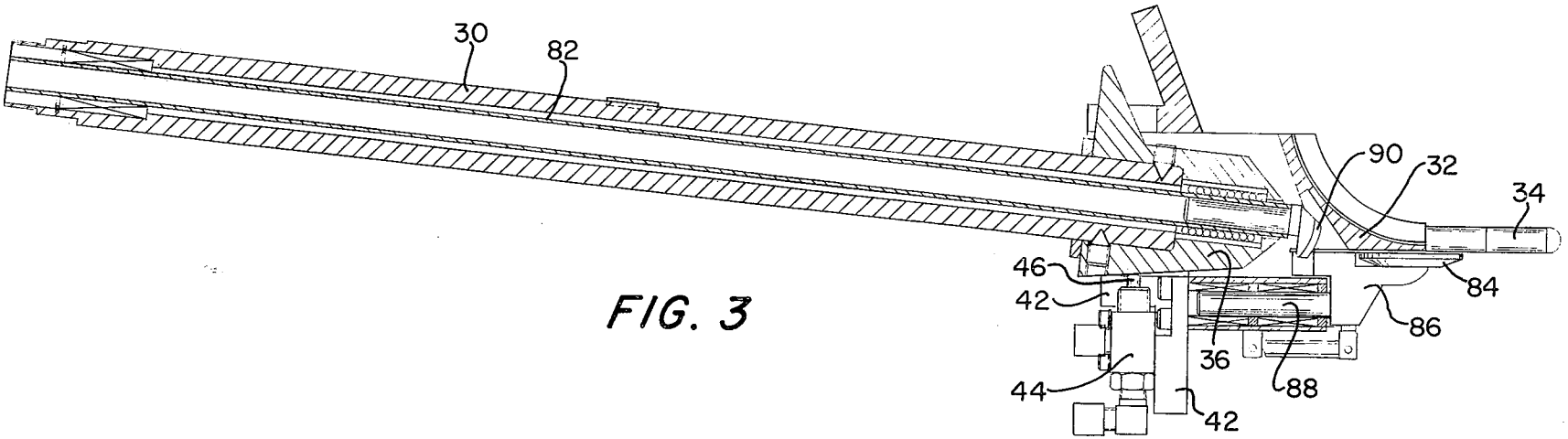
FIGS. 3 and 4 are side view of the tines and the sensing member that are mounted to the front of the tool mount.
Figure 4:
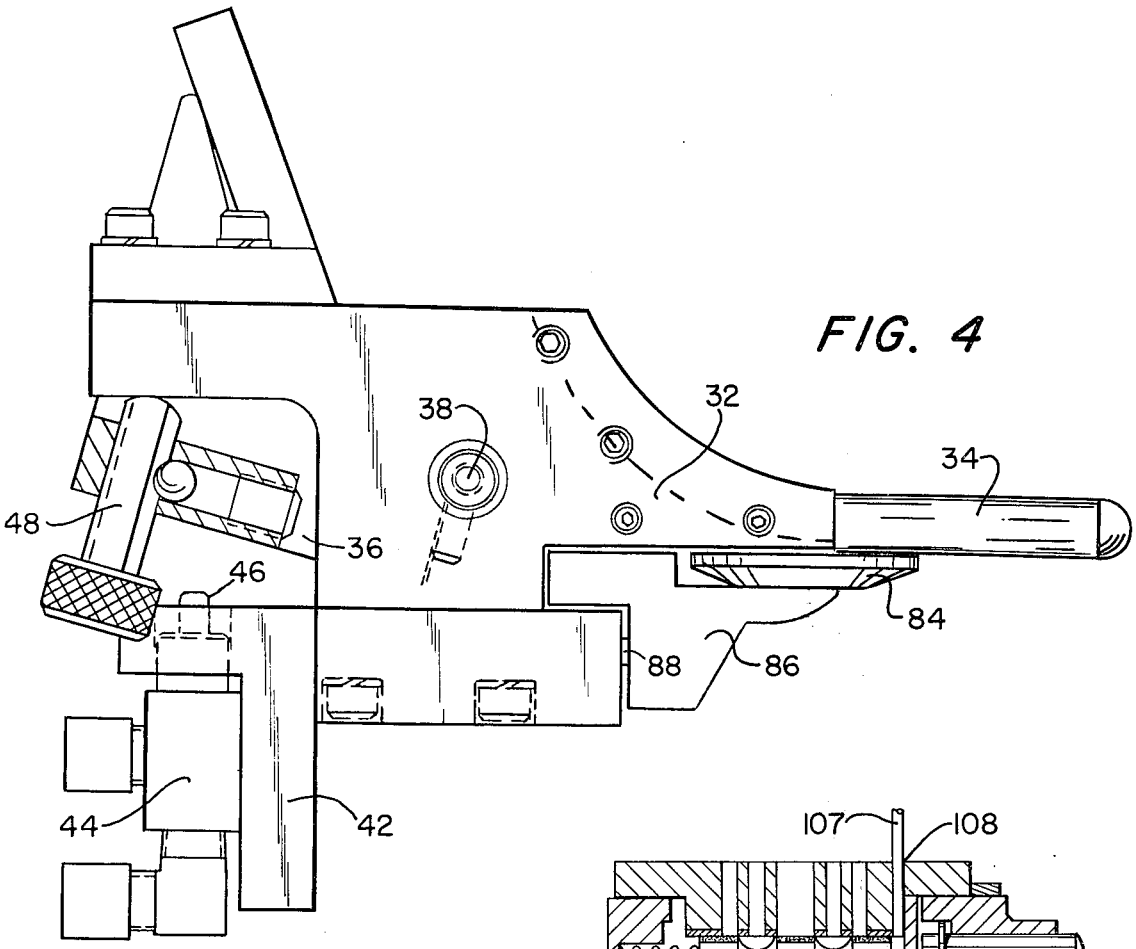
Figure 6:
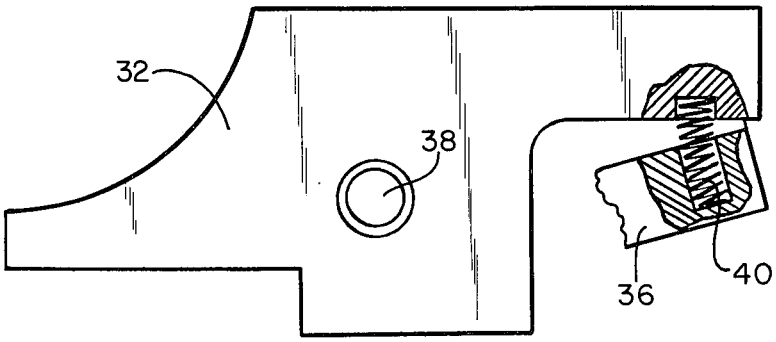
FIG. 6 is a side view showing a spring for yieldably urging the tines downwardly.

Referring to FIGS. 1 and 2, a hollow shaft 30 extends forwardly and rearwardly through the yoke 20 and is mounted in the yoke 20 that it is rotatable about its longitudinal axis but is fixed against forward-rearward movement in the yoke 20. As shown in FIGS. 1, 3, and 4, a fork 32, having a pair of forwardly extending tines 34 (see also FIG. 10A), is pivoted to a fork mount 36, that is anchored to the front of the shaft 30, for heightwise swinging movement about the axis of pivot pins 38. A compression spring 40 (FIG. 6), interposed between the fork 32 and the fork mount 36 acts to yieldably urge the fork clockwise (FIGS. 1, 3 and 4) so as to urge the fork tines 34 downwardly about the axis of the pins 38. A flange 42 (FIG. 3), mounted to the back of the fork 32, is in interecting relationship with the back of the fork mount 36 to thereby limit the extent of downward movement of the fork tines 34 about the axis of the pins 38 under the influence of the spring 40. A valve 44, mounted to the flange 42, has an upwardly directed stem 46 that is intersecting relationship with the back of the fork mount 36 and that is yieldably urged upwardly by a conventional spring in the valve. When, as shown in FIG. 3, the fork tines 34 are urged downwardly by the spring 40 and the flange 42 is abutting the back of the fork mount 36, the back of the fork mount depresses the valve stem 46 into the valve 44. When, as described below, the fork 32 is swing counterclockwise (FIGS. 1, 3 and 4) about the axis of the pins 38, a screw 48 that is mounted to the fork mount 36 abuts against the back of the fork 32, as shown in FIG. 4, to limit the extent of this counterclockwise movement.

Referring to FIGS. 1 and 2, a housing 50 is mounted to the shaft 30 by means of a front trunnion 52 and a back trunnion 54, the trunnions being so mounted to the shaft as to be locked against forward-rearward movement on the shaft. A yoke 56 is mounted, by pivot pins 58, to the front trunnion 52. A block 60 is rigidly mounted to the yoke 56. A hollow sleeve 62 extends between the block 60 on one side of the yoke 56 and a projection 64 on the other side of the yoke 56. A rougher unit 66 is pivotally mounted on the sleeve 62 for heightwise movement. The piston rod 68 of an air operated motor 70 is pivoted on a pin 72 that is mounted to the trunnion 52. The piston rod 68 is slidable in a clevis 74 which pivotally mounts the cylinder 76 of the motor 70. The clevis 74 is rigidly mounted to the rougher unit 66. The operation of the motor 70 is effective to raise and lower the cylinder 76 to thereby raise and lower the rougher unit 66 about the axis of the sleeve 62.

Figure 10:
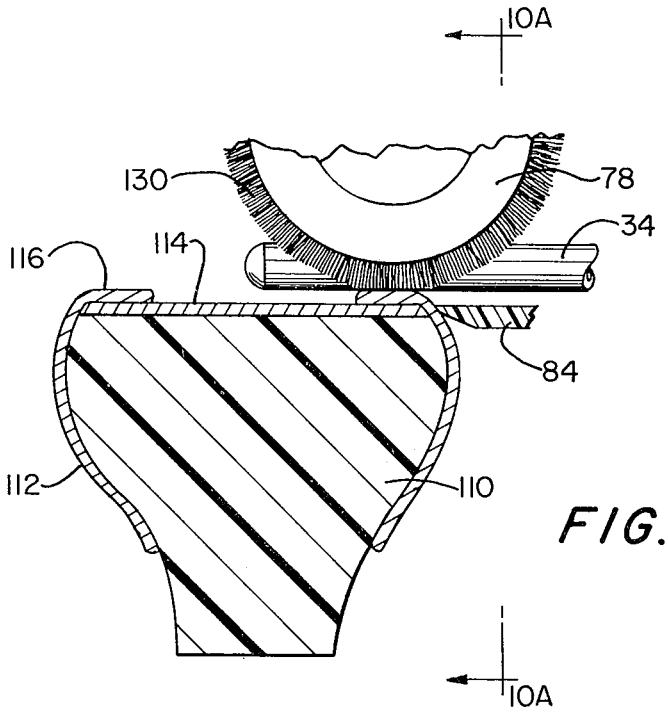
FIG. 10 is a section showing the shoe assembly, the sensing member, the tines and the roughing tool at the beginning of a roughing operation in the machine cycle.
Figure 10A:
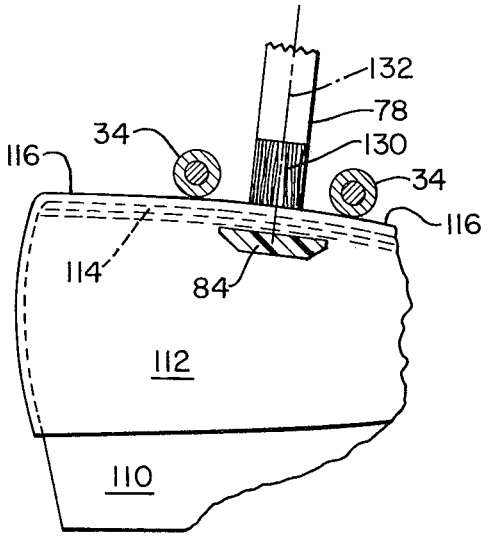
FIG. 10A is a view taken along the line 10A–10A of FIG. 10.

A roughing tool in the form of a wire brush 78 is so rotatably mounted to the front of the rougher unit 66 that the bottom of the brush periphery is located proximate to and between the fork tines 34 (see FIG. 10A). An electric motor 80 is drivingly connected to the brush 78 so as to rotate the brush.

Figure 5:
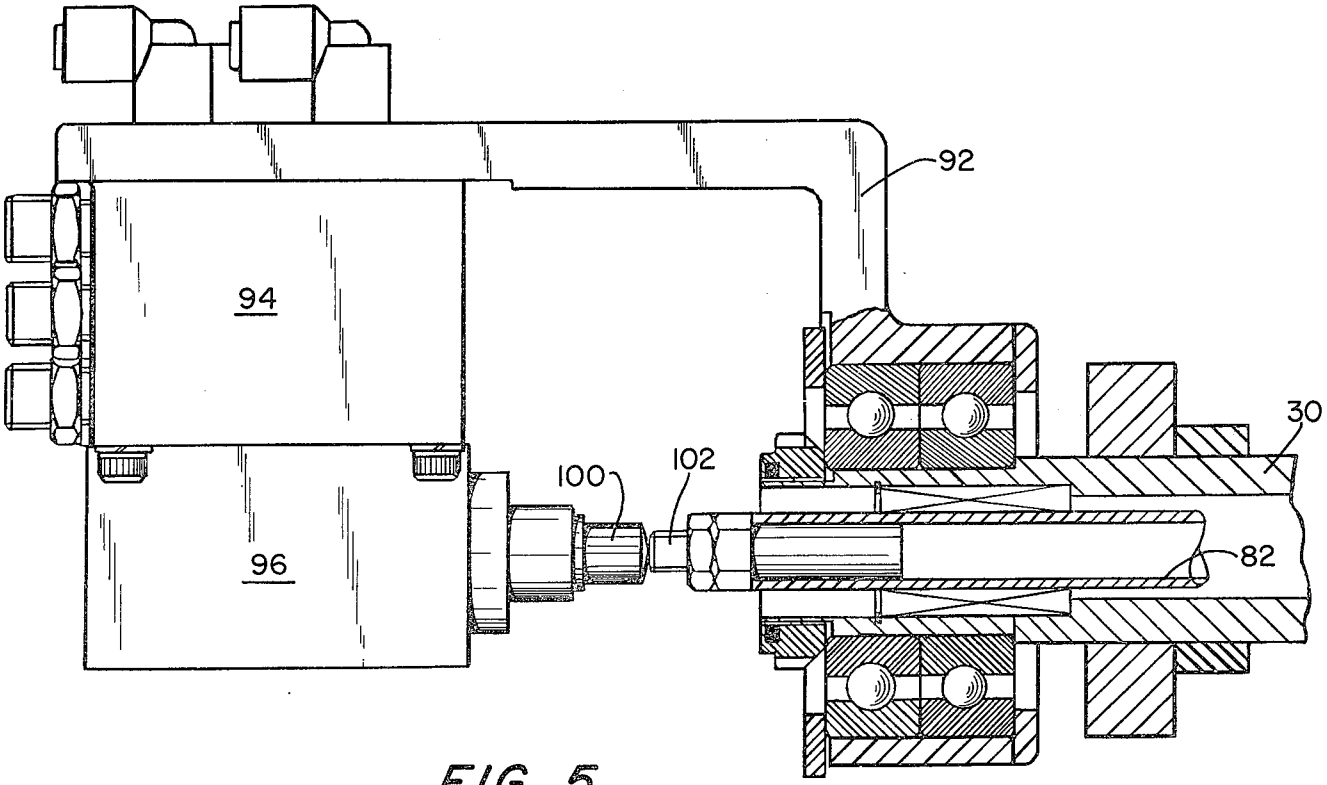
FIG. 5 is a view of a part of the actuable operating means.

Referring to FIGS. 1, 3 and 5, a bar 82 is mounted within the shaft 30 for forward-rearward movement. A sensing member 84 is mounted to a housing 86 and is located below and between the fork tines 34. Rods 88, that are secured to the housing 86 and are mounted for forward-rearward movement in the fork 32, act to mount the sensing member 84 for forward-rearward movement in the fork 32. A head 90, that is mounted to the front of the bar 82, is in intersecting relationship with the back of the housing 86 to thereby limit the extent of rearward movement of the sensing member 84 in the fork 32.

Figure 7:
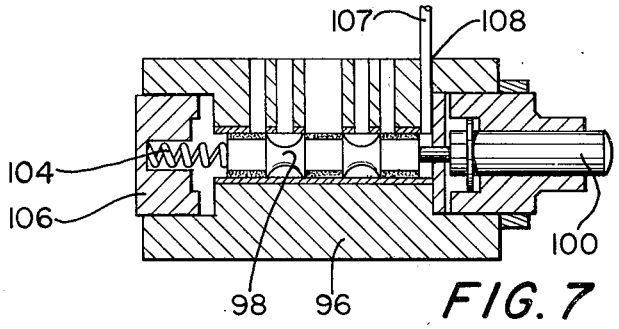
FIG. 7 is a section of a valve that forms a part of the actuable operating means.

Referring to FIGS. 5 and 7, a flange 92 is mounted to the back of the shaft 30, a manifold 94 is mounted to the flange 92 and a valve 96 is rigidly secured to the manifold 94. The valve 96 has a valve spool 98 that is reciprocably mounted in the valve 96 for forward-rearward movement. The front of the valve spool 98 is in alignment with a plunger 100 that is mounted for forward-rearward movement in the valve 96. The plunger 100 is in alignment with a pin 102 that is secured to the back of the bar 82. The valve spool 98 is yieldably urged forwardly in the valve 96 by a compression spring 104 that is interposed between a cap 106 at the back of the valve 96 and the back of the valve spool.

The valve 96 and the motor 12 are so connected to each other and to a source of hydraulic fluid under pressure as to form a servo follow up mechanism so constituted, in a known manner, that forward-rearward movement in one direction or the other of the valve spool 98 with respect to the median position shown in FIG. 7 causes corresponding motion in one direction or the other of the piston rod 14 with respect to the motor 12.

In the idle condition of the machine:pressurized air is entering the valve 96 through a line 107 and a port 108 to thereby move the valve spool 98 rearwardly against the force of the spring 104 to thus cause the servo follow up mechanism to retract the piston rod 14 into the motor 12 and thus place the slide 16, together with the fork tines 34, the rougher unit 66 and the sensing member 84, in a rearward position; the piston rods 28 are projected out of the motors 24 to thus place the fork tines 34, the rougher unit 66 and the sensing member 84 in an upper position; the spring 40 is urging the fork tines 34 downwardly about the axis of the pins 38 to a position wherein the flange 42 is abutting the back of the fork mount 36, as shown in FIG. 3, and the valve stem 46 is depressed into the valve 44; the cylinder 76 is projecting upwardly of the piston rod 68 to maintain the rougher unit 66 in an upper position with respect to the block 60 to thereby maintain the brush 78 in an upper position with respect to the fork tines 34; and the motor 80 is rotating the brush 78.

Figure 9:
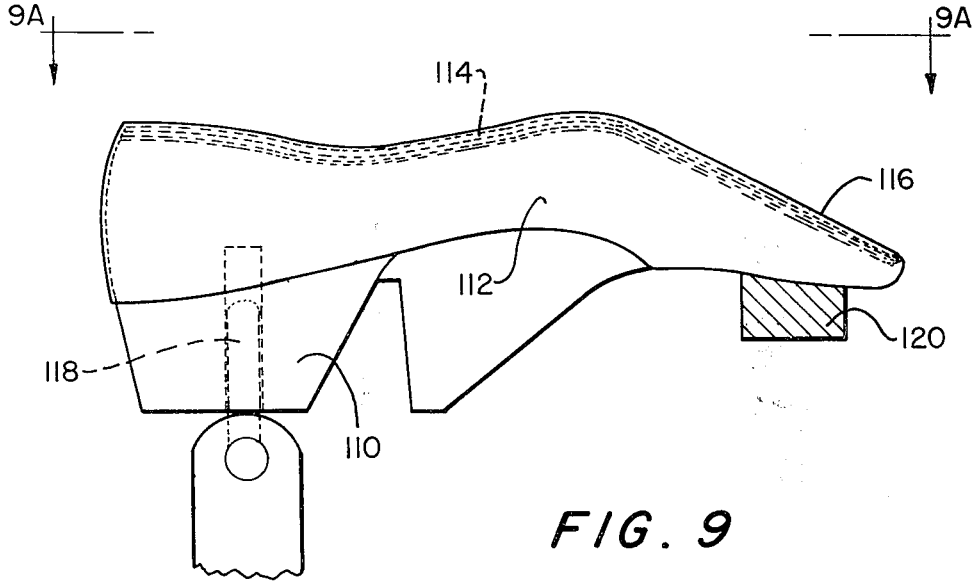
FIG. 9 is a side elevation of a shoe assembly mounted in the machine.
Figure 9A:
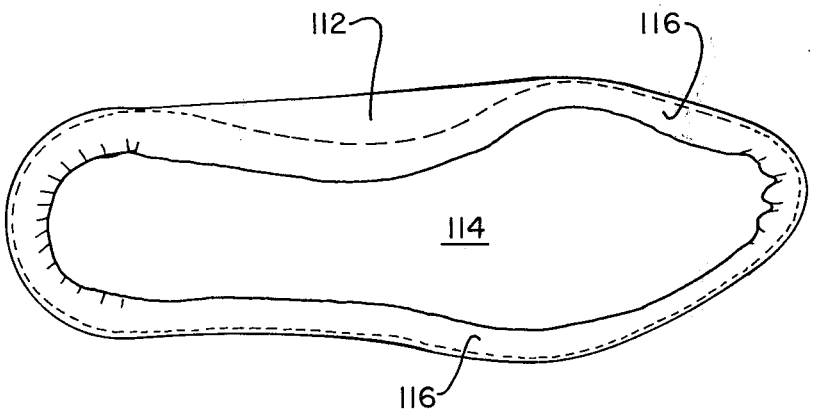
FIG. 9A is a view taken along the line 9A–9A of FIG. 9.

FIGS. 9 and 9A show a shoe assembly that comprises a last 110 having an upper 112 mounted thereon and an insole 114 located on its bottom. The upper 112 has been lasted so that the upper margin 116 lies against and is secured to the insole and extends inwardly of the periphery of the insole and the last bottom.

In the manner shown in U.S. Pat. No. 3,843,985, the shoe assembly is mounted by the operator bottom-up on a shoe assembly support that is comprised of a last pin 118 and a toe pad 120. The operator then so actuates the motors 28 under the force of pressurized air as to cause them to lower the fork tines 34, the rougher unit 66 and the sensing member 84 about the axis of the spindles 22 until the fork tines 34 engage the upper margin 116 in one of its breast line regions (FIG. 10), the shoe assembly being so located that the fork tines will intersect its bottom during their descent and the sensing member 84 will be located outwardly of the shoe assembly when the fork tines engage the shoe assembly.

Figure 8:
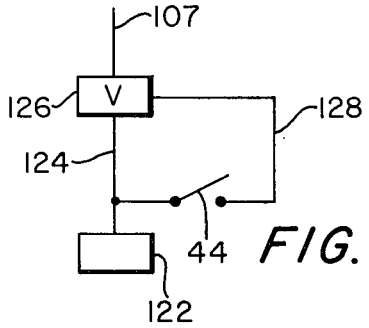
FIG. 8 is a schematic representation of the portion of the machine control circuit that incorporates the triggering means.

Referring to FIG. 8, the valve 96 is maintained in its idle position by pressurized air passing from a source 122 through a line 124 and a valve 126 into the line 107. In response to the engagement of the fork tines 34 with the upper margin 116 under the force of the pressurized air in the motors 24, the fork tines 34 swing upwardly about the axis of the pins 38 until the back of the fork 32 engages the screw 48, as shown in FIG. 4, to thereby allow the valve stem 46 to rise to open the valve 44. The closing of the valve 44 causes pressurized air to flow from the source 122 through the valve 44 and a pilot line 128 to the valve 126 to thereby so shift the valve 126 as to shut off the flow of pressurized air through the line 107.

The shutting off of the flow of pressurized air in the line 107 shuts off the flow of pressurized air in the port 108 thereby enabling the spring 104 to shift the valve spool 98, together with the plunger 100, the pin 102, the bar 82 and the sensing member 84, forwardly. This valve spool shifting actuates the motor 12, by means of the servo follow up mechanism, to project its piston rod 14 forwardly to thus move the slide 16, together with the fork tines 34, the rougher unit 66 and the sensing member 84, forwardly. This forward movement is terminated when the sensing member 84 engages the side of the shoe assembly and then moves rearwardly in the fork 32 to thereby move the bar 82, the pin 102, the plunger 100 and the valve spool 98 rearwardly, the valve spool 98 moving rearwardly against the force of the spring 104 until the valve spool arrives in the median position shown in FIG. 7 in the valve 96. The arrival of the valve spool in the median position enables the servo follow up mechanism to terminate forward movement of the piston rod 14.

The closing of the valve 44 also acts, after a time delay sufficient to enable the sensing member 84 to engage the side of the shoe assembly, to actuate the motor 70 so as to lower the cylinder 76 under the force of pressurized air to thereby swing the rougher unit 66 downwardly about the axis of the sleeve 62 until radially projecting bristles 130 on the brush 78 engage the upper margin 116 between the fork tines 34, as indicated in FIGS. 10 and 10A, and to cause the shoe assembly support, comprised of the last pin 118 and the toe pad 120, to be so operated in the manner shown in U.S. Pat. No. 3,843,985 as to move the entire upper margin 116 past the rotating brush 78 to thereby enable the brush bristles 130 to rough or abrade the upper margin.

During the movement of the upper margin past the roughing brush 78, the brush must move upwardly or downwardly in accordance with the elevation of the portion of the upper margin being roughed and must move forwardly and rearwardly so as to be positioned the desired distance inwardly of the portion of the outer periphery of the upper margin 116 being roughed. In addition, the central plane of the brush 78 which is at right angles to its axis of rotation, indicated by the chain line 132 in FIG. 10A, should be tilted during the movement of the portions of the upper margin 116 being roughed past the roughing brush 78 so as to be at right angles to the plane of the portion of the upper margin being roughed.

The upward and downward movement of the brush 78 during the movement of the upper margin past the brush is accomplished by virtue of the fact that the brush is mounted to partake of the swinging movement of the yoke 20 and is thus resiliently urged downwardly by the air operated motors 24.

The forward and rearward movements of the brush 78 during the movement of the upper margin past the brush is accomplished by the sensing member 84 which is being resiliently urged forwardly against the side of the shoe assembly by the spring 104. The servo follow up mechanism is so constituted that the piston rod 14 is stationary to maintain the brush position stationary in forward-rearward directions when the valve spool 98 is in a median position in the valve 96. A forward movement of the sensing member 84 by a portion of the side of the shoe assembly being displaced from the sensing member causes the valve spool 98 to move forwardly in the valve 96 to thereby cause the servo follow up mechanism to so operate the motor 12 as to move the piston rod 14 forwardly and thus move the brush 78 and the sensing member 84 forwardly until the sensing member again engages the side of the shoe assembly and thereby causes the bar 82 to move the valve spool 98 into its median position in the valve 96. A rearward movement of the sensing member 84 by a rearward pushing of the sensing member by a portion of the side of the shoe assembly causes the bar 82 to move rearwardly to push the valve spool 98 rearwardly in the valve 96 to thereby cause the servo follow up mechanism to so operate the motor 12 as to move the piston rod 14 rearwardly and thus move the brush 78 and the sensing member 84 rearwardly until the side of the shoe assembly stops pushing the sensing member rearwardly so that the valve spool 98 regains its median position in the valve 96.

The tilting of the central plane 132 of the brush 78 is accomplished in the manner disclosed in U.S. Pat. No. 3,843,985.

After the entire upper margin 116 has been moved past the roughing brush 78, the movement of the shoe assembly support comprised of the last pin 118 and the toe rest 120 is terminated and the machine parts are returned to their idle position, the machine cycle thus being completed. The shoe assembly, with the roughed upper margin, is now removed from the machine.

As stated above, the shoe assembly is so located that the fork tines 34 will intersect, and thus engage, the shoe assembly bottom during their descent at the beginning of the machine cycle. The sensing member 84 is then caused to move forwardly to engage the side of the shoe assembly in response to the engagement of the fork tines 34 with the shoe assembly bottom. This arrangement ensures that when the fork tines 34 and the sensing member 84 are moved from their idle position into their shoe assembly engaging positions, the fork tines will not descend outwardly of the shoe assembly and thereby not come into engagement with the upper margin 116. In addition, this arrangement ensures that the sensing member 84, when it is moved forwardly towards the shoe assembly from its idle position, will intersect the side of the shoe assembly proximate to the upwardly facing bottom of the shoe assembly, as shown in FIGS. 10 and 10A, and will not cross over the uppermost portion of the side of the shoe assembly and then, undesirably, advance over the upwardly facing bottom of the shoe assembly.

There follows a recapitulation of the machine construction and the mode of operation of the machine in accordance with this invention.

The machine is intended to rough the margin of an upper of a shoe assembly that comprises a last 110 having an insole 114 located on its bottom and the upper mounted thereon with the upper margin 116 lying against and being secured to the periphery of the insole. The machine includes a shoe assembly support, that is comprised of the last pin 118 and the toe pad 120, that supports the shoe assembly bottom-up. The slide 16 is mounted for forward-rearward movement toward and away from the shoe assembly and is caused to effect this movement by the motor 12, which constitutes a first motor, that is connected to the slide. The yoke 20, the shaft 30, the fork mount 36 and the rougher unit 66 comprises a tool mount that is mounted to the slide 16 for heightwise movement. The motors 24 each constitutes a second yieldable motor that is connected to the tool mount for effecting the heightwise movement of the tool mount. The tines 34 each constitute a tine that is mounted to the tool mount, and also mounted to the tool mount is the sensing member 84. The pins 38 constitute means mounting the tines 34 to the tool mount for heightwise movement and the spring 40 constitutes means yieldably urging the tines into a lower position relative to the tool mount. The housing 86, the head 90, the bar 82, the pin 102, the plunger 100, the valve 96, the valve spool 98, the spring 104 and the connections between the valve 96 and the first motor 12 form an actuatable operating means so connecting the sensing member 84 and the first motor 12 as to cause the first motor to move the slide 16 from a rearward idle position wherein the sensing member is spaced from the shoe assembly forwardly until the sensing member engages a particular portion of the side of the shoe assembly and to enable the first motor to retain the sensing member in engagement with successive portions of the side of the shoe assembly with a consequent forward or rearward movement of the tool mount as the successive portions of the side of the shoe assembly move past the sensing member. The pressurized air entering the valves 96 through the line 107 and the post 108 constitutes means for initially deactuating the operating means so that the first motor 12 retains the slide 16 in said idle position.

In the operation of the machine, the slide 16 initially is retained in said idle position by the first motor 12 and the controls for the second motors 24 cause the second motors 24 to retain the tool mount in an upper position spaced from the shoe assembly. This is followed by an actuation of the controls for the second motors 24 to cause the second motors to yieldably lower the tool mount so as to bring the tines 34 into engagement with the bottom of the shoe assembly. In response to the engagement of the tines 34 with the bottom of the shoe assembly, the tines are moved upwardly relative to the tool mount to thereby cause triggering means shown in FIG. 7 that comprises the control means formed by the valve 44 to actuate the operating means. Means shown in U.S. Pat. No. 3,843,985 are thereafter operative to move the shoe assembly support so as to move successive portions of the shoe assembly past the tool mount and thus move successive portions of the side of the shoe assembly past the sensing member 84 and move successive portions of the bottom of the shoe assembly past the tines 34. The roughing tool 78 is so mounted to the tool mount as to be in engagement with and rough successive portions of the upper margin 116 as said successive portions of the shoe assembly move past the tool mount.

I claim:

1. A machine for roughing the margin of an upper of a shoe assembly, said shoe assembly comprising a last having an insole located on its bottom and the upper mounted thereon with the upper margin lying against and being secured to the periphery of the insole, comprising: a shoe assembly support for supporting the shoe assembly bottom-up; a slide mounted for forward-rearward movement toward and away from the shoe assembly; a first motor connected to the slide for effecting said forward-rearward movement; a tool mount mounted to the slide for heightwise movement; a second yieldable motor connected to the tool mount for effecting said heightwise movement; a tine mounted to the tool mount; a sensing member mounted to the tool mount below the tine; actuable operating means so connecting the sensing member and the first motor as to cause the first motor to move the slide from a rearward idle position wherein the sensing member is spaced from the shoe assembly forwardly until the sensing member engages a particular portion of the side of the shoe assembly and to enable the first motor to retain the sensing member in engagement with successive portions of the side of the shoe assembly with a consequent forward or rearward movement of the tool mount as the successive portions of the side of the shoe assembly move past the sensing member; means for initially deactuating the operating means so that the first motor retains the slide in said idle position; means for initially causing the second motor to retain the tool mount in an upper position spaced above the shoe assembly; means for causing the second motor to yieldably lower the tool mount so as to bring the tine into engagement with the bottom of the shoe assembly; triggering means responsive to the engagement of the tine with the bottom of the shoe assembly to actuate said operating means; means operative to thereafter so move the shoe assembly support as to move successive portions of the shoe assembly past the tool mount thereby moving successive portions of the side of the shoe assembly past the sensing member and thereby moving successive portions of the bottom of the shoe assembly past the tine; and a roughing tool so mounted to the tool mount as to be in engagement with successive portions of the upper margin as said successive portions of the shoe assembly move past the tool mount.

2. The machine according to claim 1 further comprising: means mounting the tine to the tool mount for heightwise movement; and means yieldably urging the tine into a lower position relative to the tool mount so that the tine can move upwardly relative to the tool mount upon said engagement of the tine with the bottom of the shoe assembly; and wherein said triggering means comprises control means operative in response to said upward movement of the tine.

* * * * *

UNITED STATES PATENT OFFICE

CERTIFICATE OF CORRECTION

Patent No. 3,932,907 Dated January 20, 1976

Inventor(s) Walter Vornberger

It is certified that error appears in the above-identified patent and that said Letters Patent are hereby corrected as shown below:

Column 4: line 59, change "closing" to --opening-- .

Signed and Sealed this

*twenty-seventh* Day of *April 1976*

[SEAL]

*Attest:*

RUTH C. MASON
*Attesting Officer*

C. MARSHALL DANN
*Commissioner of Patents and Trademarks*